United States Patent [19]

Klaren

[11] Patent Number: 4,616,698

[45] Date of Patent: Oct. 14, 1986

[54] HEAT EXCHANGER FOR LIQUID/LIQUID HEAT EXCHANGER

[75] Inventor: Dick G. Klaren, Hillegom, Netherlands

[73] Assignee: Esmil BV, Amsterdam, Netherlands

[21] Appl. No.: 368,569

[22] Filed: Apr. 15, 1982

[30] Foreign Application Priority Data

Apr. 24, 1981 [NL] Netherlands ..... 8102024

[51] Int. Cl.[4] ..... F28D 13/00; F28D 3/02

[52] U.S. Cl. ..... 165/104.16; 165/115

[58] Field of Search ..... 165/115, 118, 104.16

[56] References Cited

U.S. PATENT DOCUMENTS 2,267,568 12/1941 Kleucker .
4,119,139 10/1978 Klaren ..... 165/104.16 X
4,220,193 9/1980 Klaren .
4,300,625 11/1981 Mikhailov et al. ..... 165/104.16 X

FOREIGN PATENT DOCUMENTS 601535 7/1960 Canada ..... 165/104.16
633570 1/1928 France .
1462749 12/1966 France .
79485 9/1931 Sweden ..... 165/115

*Primary Examiner*—Albert W. Davis, Jr.
*Attorney, Agent, or Firm*—Stevens, Davis, Miller & Mosher

[57] ABSTRACT

A heat exchanger for liquid/liquid heat exchange has a plurality of parallel vertical tubes arranged for the upward transport within the tubes of a first heat-exchange liquid, supply and discharge tanks for the first liquid into which the lower and upper ends of the tubes respectively open. A granular mass is fluidized during operation by the flow of the first liquid so as to occupy at least the tubes. Supply and discharge means for a second heat exchange liquid bring the second liquid into contact with the outer surface of the tubes. In order to improve the heat flow between the second liquid and the tubes, the supply means for the second liquid causes the second liquid to contact the tubes in the form of a film flowing downwardly along the outer surface of each tube.

6 Claims, 2 Drawing Figures

HEAT EXCHANGER FOR LIQUID/LIQUID HEAT EXCHANGER

BACKGROUND OF THE INVENTION

1. Field of the Invention

The invention relates to a heat exchanger for liquid/-liquid heat exchange of the type having a plurality of parallel vertical tubes which transport a first heat exchange liquid upwardly, a second heat exchange liquid being brought into contact with the outside surface of the tubes.

2. Description of the Prior Art

U.S. Pat. Nos. 4,119,139, 3,991,816 and 4,220,193 disclose such heat exchangers which in addition contain a granular mass (i.e. a particle mass) which is fluidized during operation by the upward flow of the first liquid so as to occupy at least the tubes.

An advantage of these known heat exchangers is that the fluidized granular mass has a cleaning effect on the inner surface of the tubes and in addition provides a considerable improvement in the heat flow between the first liquid and the tube walls. In many cases there is also a need for a high rate of heat transfer between the tube wall and the second heat exchange liquid. In the known apparatus the tubes run within a cylindrical container through which the second liquid is passed, possible in the reverse direction. The total flow cross section for the second liquid within these closed containers and over the outer surface of the tubes is usually greater than the total flow cross section through the tubes, which with comparable volumes of the first and second heat exchange liquids may lead to a significantly lower velocity for the second heat exchange liquid in comparison with the first. The result is that the heat transfer between the tube wall and the second liquid is relatively low.

Although this disadvantage can, at least in theory, be partly overcome by making a large number of corrugations on the outside surfaces of the tubes so that the liquid velocities over the tubes can be raised with a consequent improvement in the heat transfer in the heat exchanger, such an arrangement makes the heat exchanger more complicated and therefore more expensive. In addition more pump power may be necessary to pump the second liquid, while in practice it seems that in fact no significant improvement in heat transfer can be obtained in this way.

Because the heat flow at the inner side of the tube walls is improved by the use of the fluidized granular mass, the velocity of the first liquid can be kept lower if the process should require it. In that case, larger numbers of tubes with larger diameters are necessary in order to transfer the same quantity of liquid. In their turn these larger tubes lead to an extra increased transfer rate of the second heat exchange liquid on the outside of the tubes, with the difficulties already discussed.

SUMMARY OF THE INVENTION

The object of the present invention is to increase the heat exchange capacity of heat exchangers of the tube type by improving the heat flow on the outside surfaces of the tubes.

The invention consists in causing the second heat exchange liquid to form a downwardly moving film over the surface of the tubes.

Preferably the formation of this film is achieved by means of an annular slot around each of the tubes through which slot the second heat exchange liquid passes so as to form a film flowing downwardly along the tube. Suitably the discharge means which collects the films from the tubes is a tank having a base through which the tubes pass, side walls and an outlet. Not all of the liquid in the film must be caught in this tank, for instance in applications where part of the second liquid is evaporated.

Instead of forced convection for the second heat exchange liquid outside the tubes inside closed manifolds which must be filled as in the prior art, the heat flow at the outside of the tubes is now obtained by making the second liquid flow as a film downwardly along the tubes. A heat transfer mechanism is here employed on the outside of the tubes which corresponds very much with the heat transfer mechanism on the inner side of the tubes. This leads to an extra degree of freedom in the construction of the heat exchanger, which makes it possible to optimize the results obtained.

It is known that the heat transfer between a liquid film and a solid surface can be very high, even with a very small transport rate of the liquid along the solid surface. The possibility arises here that with comparable mass flows through and over the tubes, there may be improved heat transfer between the two liquid streams which are in addition flowing in opposite directions. It is found that with a conventional choice of tube material and wall thickness, a heat transfer coefficient of 3000 to 6000 W/m2 oK can be obtained in the tube.

It should be noted that such heat transfer coefficients have hitherto as a rule only been achieved with plate heat exchangers. Plate heat exchangers pose considerable difficulties for reasons of construction, cost and operation, compared with tube heat exchangers of the type described above. In any case plate heat exchangers can only be used for liquids with limited contaminating properties, since repeated cleaning of the heat transfer surfaces is not as a rule to be recommended. In addition plate heat exchangers require complicated and vulnerable sealing arrangements, and can in addition only be run within a limited range of temperatures and pressures. All these difficulties do not arise in the case of heat exchangers constructed according to the invention. Even when passing liquids with strongly contaminating properties, these tubes remain clean because of the scouring action of the granular mass. On their outsides, the tubes may easily be kept clean because the second liquid does not have to be contained in a closed manifold, so that the tubes can be easily accessible from the outside for cleaning.

The supply means for conveying the second liquid to the tubes can consist of individual distribution chambers for each tube. However, it is preferred that the supply means comprises a single tank with an apertured base, passing through the apertures so as to leave free annular slots.

The heat exchanger according to the invention is not limited to heat exchange between the first liquid and a single second heat exchange liquid. On the contrary, the supply and discharge means may be constructed for the separate flow of different liquids along the tube walls. This can be achieved by providing separate supply and discharge means for forming films of liquid over the tubes in different regions of the tube bundle. In this case two heat exchangers are coupled in parallel in the one device, with only the first heat transfer liquid being in common. For constructional reasons a heat exchanger for exchanging heat with more than one second liquid should preferably be so designed that, from the top of the tubes downwardly, the supply and discharge systems for the various second liquids are located alternately in pairs. This may then represent a series connection of the heat exchangers, having common tubes for the first liquid.

It has already been mentioned that the tubes do not have to be mounted within a sealed vessel, and that for this reason the tubes can easily be cleaned from outside. Nevertheless in order to avoid problems from splashing of the liquid or vapour formation, it is preferred in many cases to locate the tube assembly within a removable outer casing. This housing may be formed as a light sheeting.

BRIEF INTRODUCTION OF THE DRAWINGS

The preferred embodiments of the invention will now be described by way of non-limitative example with reference to the accompanying drawings, in which:

FIG. 1 is a somewhat diagrammatic vertical sectional view of a heat exchanger embodying the invention, and FIG. 2 is a variant of the heat exchanger of FIG. 1 for a multiple application.

DESCRIPTION OF THE PREFERRED EMBODIMENTS

Figure 1:
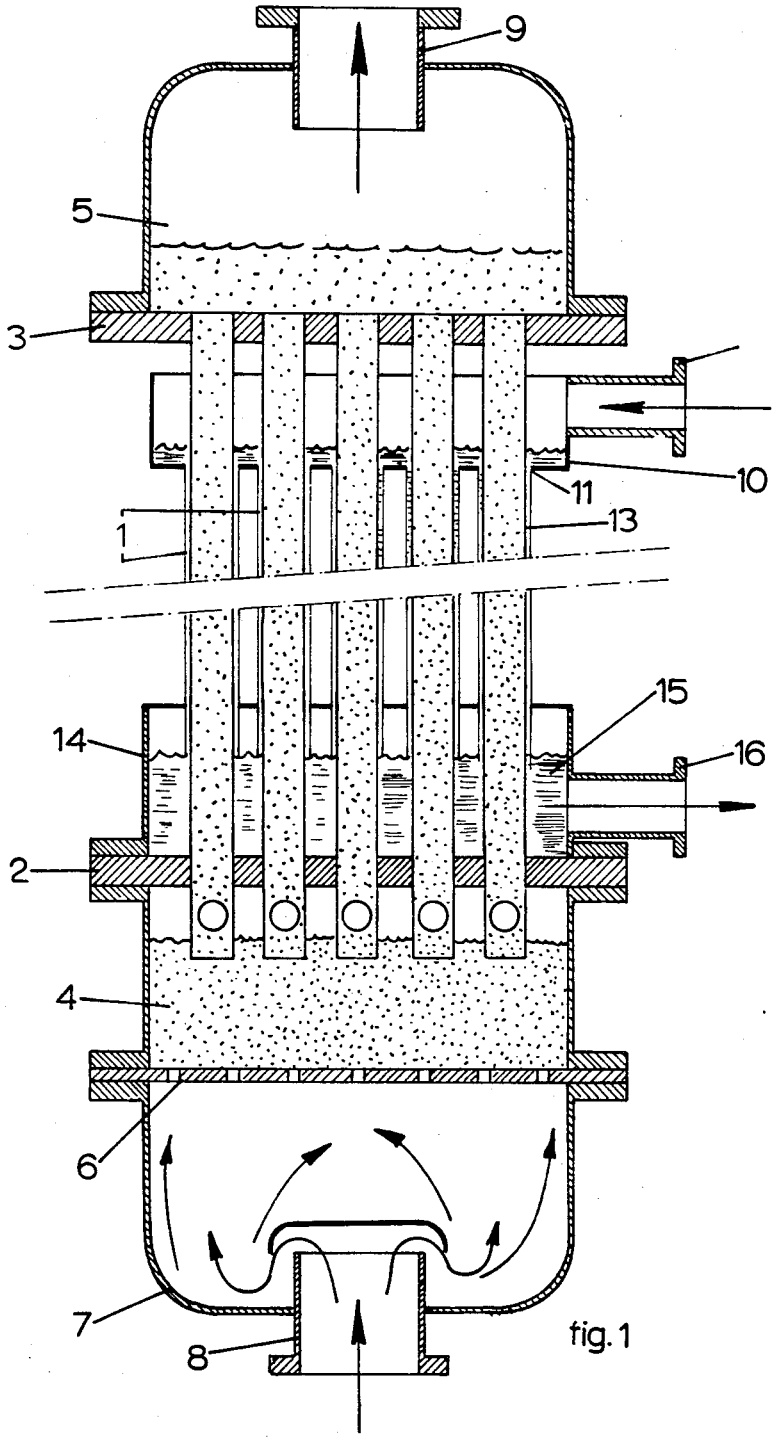

In the heat exchanger of FIG. 1, a plurality of vertical tubes 1 through which the first heat exchange liquid flows upwardly are secured in upper and lower tube plates 2 and 3 sealingly, and open at their ends in a lower chamber 4 and an upper chamber 5. The lower chamber 4 is bounded below by a perforated distribution plate 6, which separates the chamber 4 from a lower chamber 7, into which the first liquid flows via an inlet opening 8. This liquid is finally discharged via an outlet opening 9. In the volume occupied by the first liquid above the distribution plate 6, there is a granular mass which during operation is fluidized by the upward motion of the first heat exchange liquid, so that it appears in the condition shown in the Figure. More details of this known technique can be found in the US patents mentioned above, which also show other constructions for the supply of the first liquid to the tubes and the uniform fluidisation of the granular mass in the tubes. Near the tube plate 3, there is constructed around the tubes 1 a tank 10 having circular holes in its base of a larger size than the outside diameter of the tubes 1. The tubes 1 pass through these holes so as to form an annular slot around each tube. The second heat exchange liquid enter the tank 10 through the inlet opening 12. Close to the lower end of the tubes 1 a collection tank for the second liquid is formed by the tube plate 2 and an upstanding wall 14 having a discharge outlet 16. The second liquid passes from the supply tank 10 through the annular slots 11 to form a film 13 around each tube 1, the film flowing downwardly along the tube into the tank 14 where it collects. The collected liquid 15 flows away via the outlet opening 16.

The principles and advantages of this heat exchanger have been fully discussed above.

Figure 2:
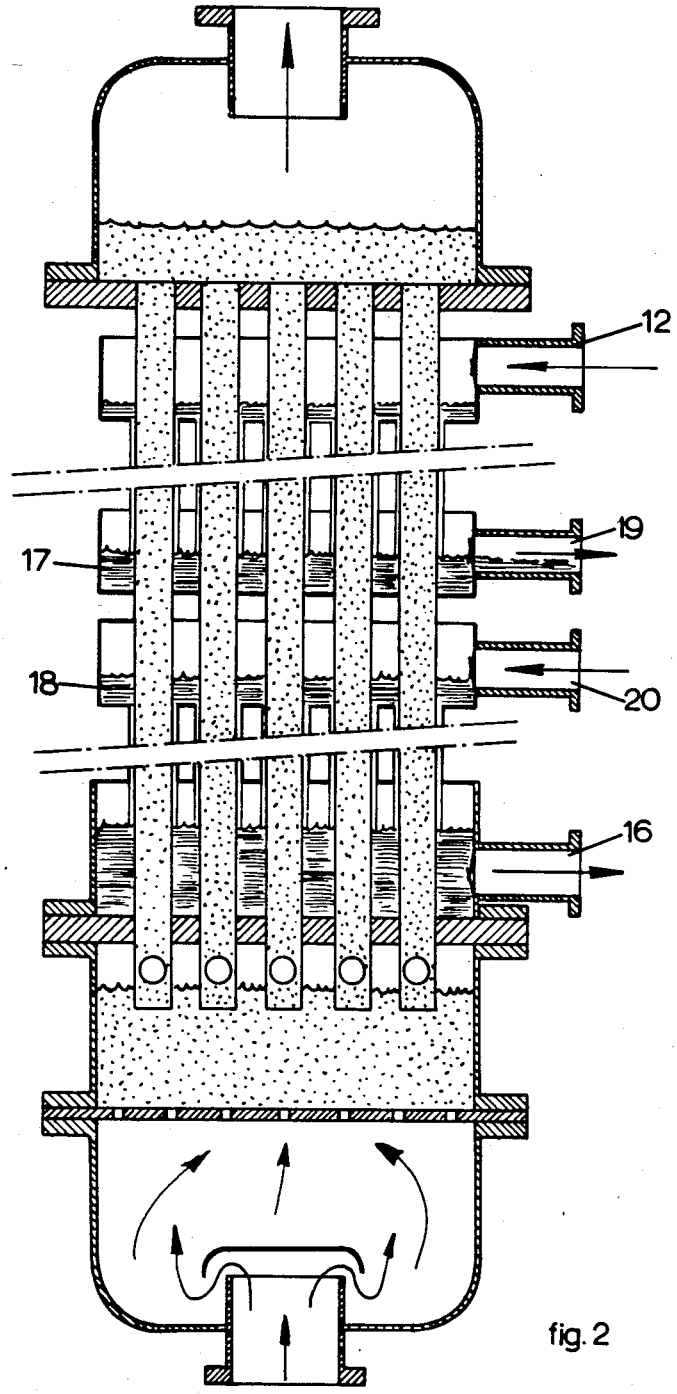

FIG. 2 shows a variant of this arrangement, where corresponding elements have the same function. In this figure there are two extra tanks 17 and 18 having outlet and inlet openings 19 and 20. It is clear that another liquid can be introduced between inlet 12 and outlet 19, different from that between inlets 20 and 16. Depending on the process to which the heat exchanger is being applied, it may be convenient to connect more such heat transfer columns in series either for more than one liquid or for the same liquid at different phases of the same process.

What is claimed is:

1. Heat exchanger for liquid-liquid heat exchange having a plurality of parallel vertical tubes arranged for the upward transport within the tubes of a first heat-exchange liquid, supply and discharge tanks for the first liquid into which lower and upper ends of the said tubes respectively open, a granular mass which during operation is fluidized by the flow of the first liquid so as to occupy at least the said tubes, supply means for a second heat exchange liquid arranged to cause the second liquid to contact the tubes in the form of a film flowing downwardly along the outer surface of each tube, said supply means for the second liquid having a slot extending around each of the said tubes, so that the second liquid forms the said film on passing through the slot and the discharge means for the second liquid arranged to collect the said films from the tubes.

2. Heat exchanger according to claim 1 wherein the supply means for the second liquid comprises a tank through which the tubes pass, the tank having a base having apertures for the tubes which apertures are larger than the tubes so as to leave around each tube the said slot through which the second liquid flows to form said film.

3. Heat exchanger according to claim 1 or claim 2 wherein the discharge means for the second liquid comprises a tank through which the tubes pass, which tank has a base which is closed to the tubes, upstanding side walls and a discharge outlet.

4. Heat exchanger according to claim 1 having a plurality of supply and discharge means for respective second heat exchange liquids, arranged to allow said second liquids to contact the tube surfaces as downwardly flowing films respectively at separate regions of tubes.

5. Heat exchanger according to claim 4 wherein respective supply and discharge means for two second liquids are arranged in alternation along the tubes.

6. Heat exchanger according to claim 1 or claim 4 having an easily removable housing which encloses the heat exchange region of the tubes.

* * * * *